United States Patent [19]

Chaillot

[11] Patent Number: 4,834,681

[45] Date of Patent: May 30, 1989

[54] ELECTRIC CONTACT TERMINAL

[75] Inventor: Georges Chaillot, Nogent le Roi, France

[73] Assignee: Francelco, Suresnes, France

[21] Appl. No.: 241,380

[22] Filed: Sep. 6, 1988

[30] Foreign Application Priority Data

Sep. 28, 1987 [FR] France ..... 87 13374

[51] Int. Cl.[4] ..... H01R 11/22

[52] U.S. Cl. ..... 439/856; 439/852

[58] Field of Search ..... 439/834, 842, 845, 849–857, 439/885

[56] References Cited

U.S. PATENT DOCUMENTS

| | | | |
|---|---|---|---|
| 3,663,931 | 5/1972 | Brown | 439/857 |
| 3,786,401 | 1/1974 | Jones et al. . | |
| 4,564,259 | 1/1986 | Vandame | 439/852 |
| 4,566,752 | 1/1986 | Hemmer | 439/842 |

FOREIGN PATENT DOCUMENTS

| | | | |
|---|---|---|---|
| 3424072 | 1/1986 | Fed. Rep. of Germany | 439/857 |
| 2308217 | 11/1976 | France | 439/842 |
| 2489637 | 1/1981 | France . | |

*Primary Examiner*—David Pirlot

*Attorney, Agent, or Firm*—Larson and Taylor

[57] ABSTRACT

An electric contact terminal consists of a stamped and bent metal sheet part. It has a bottom and two sides connected to said bottom and extending laterally inwardly to constitute a ceiling whereby an elongated cage-like part is defined. Each of the sides has an internal wall laterally connected to an external wall in tight contact therewith by an 180° bend. Each internal wall has a front cantilevered contact portion projecting forwardly in the direction of elongation, while each external wall has a front flap inwardly bent back about an edge orthogonal to the direction of elongation. Each flap retains a respective one of the cantilevered contact portions out of contact with the other contact portion.

10 Claims, 3 Drawing Sheets

ELECTRIC CONTACT TERMINAL

BACKGROUND OF THE INVENTION

1. Technical Field

The present invention relates to electric contact terminals for receiving a contact blade. It relates more particularly to terminals of the type made by stamping and bending of a metal sheet, having a cage-like body, with a bottom connected to two sides each having an internal wall connected laterally to an external wall by an 180° bend and having a front, cantilevered contact portion.

2. Prior Art

Contact terminals of the above defined type are already known; since they can be manufactured by stamping and bending—and possibly rolling—a metal sheet, they are much less expensive than machined terminals. On the other hand, existing stamped and bent metal sheet contacts have a number of drawbacks. If the terminal is made with the contact forming portions of the internal walls in mutual abutment at rest for opposing a high force to their spreading apart by the blade, this is favorable to a good quality electric connection but increases the insertion force and generates a risk of defective introduction. The first drawback may become serious if a large number of contact terminals are provided in the same connector. If, on the other hand, the contact forming portions are initially separated, their bearing force on the contact blade may in some cases be insufficient to provide a satisfactory electrical connection.

SUMMARY OF THE INVENTION

It is an object of the invention to provide a contact terminal which achieves a satisfactory electrical connection and provides guidance for the male contact blade when it is introduced. With this purpose in mind, each external wall has at a front flap inwardly bent about an edge transversal to the internal wall, retaining the front portion of the internal wall under flexional prestress in a position where it is out of contact with the internal wall of the other side.

As long as the gap at rest between the closest zones of the front portions is less than the thickness of the blade inserted into the terminal, a good quality electric connection is obtained. The flap, which may end very close to these zones of the contact which are at a minimum mutual distance, provides preguiding of the blade during its introduction. The distance between the contacts is constant whatever the pressure exerted. The presence of a gap between the contact zones makes it possible to deposit thereon an electrolytic protective coating. Due to the initial gap between the contact zones, the force required for inserting the contact blade is reduced.

Most of the presently existing bent metal sheet contact terminals have the further drawback that they are crushed if for example a worker steps on them, even when they are connected to a wire. Attempts have already been made to prevent such crushing by providing one of the internal walls with a rear extension consisting of a flap bent by 90° inwardly and bearing against the other internal wall. It is another object of the invention to provide a contact terminal having increased resistance to crush so that the rear flap, if provided, does not need to abut the opposite side; the flap may have the function to preventing a sealing product, when it is molded into the connector, from infiltrating into the body of the terminal and subsequently hindering the electric connection.

For increased resistance to crushing, the two walls of each side may be bent at right angles in their mutually bearing zones, so that the 180° bends face each other in the immediate vicinity of each other. Under these conditions, if a crushing force is exerted on the terminal, these bends bear against each other and oppose a high resistance to deformation.

The invention will be better understood from the following description of a particular embodiment of the invention, given by way of example only. The description refers to the drawings.

DETAILED DESCRIPTION OF A PREFERRED EMBODIMENT

Figure 1:
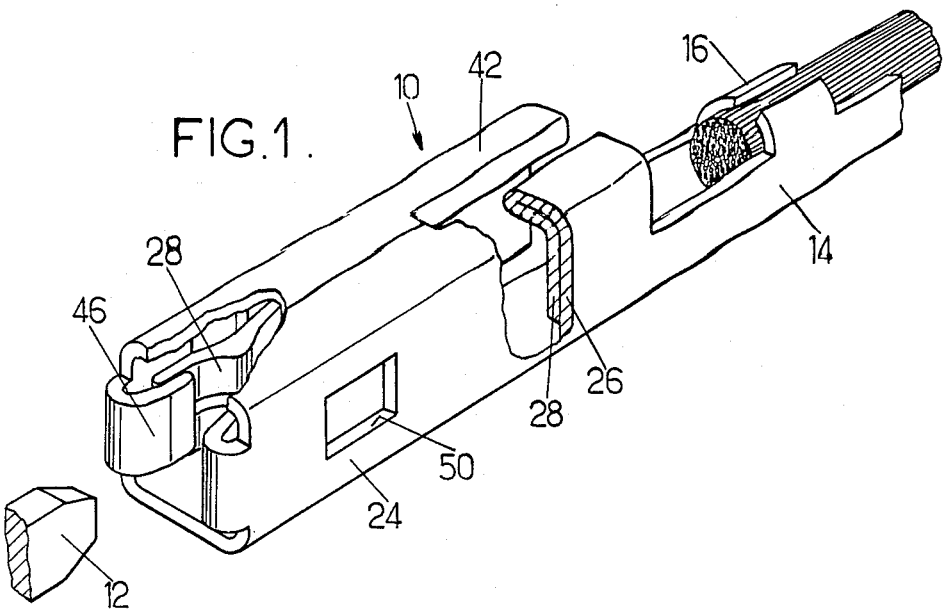
FIG. 1 is a perspective view partly cut away, showing a construction of a terminal according to an embodiment of the invention.
Figure 2:
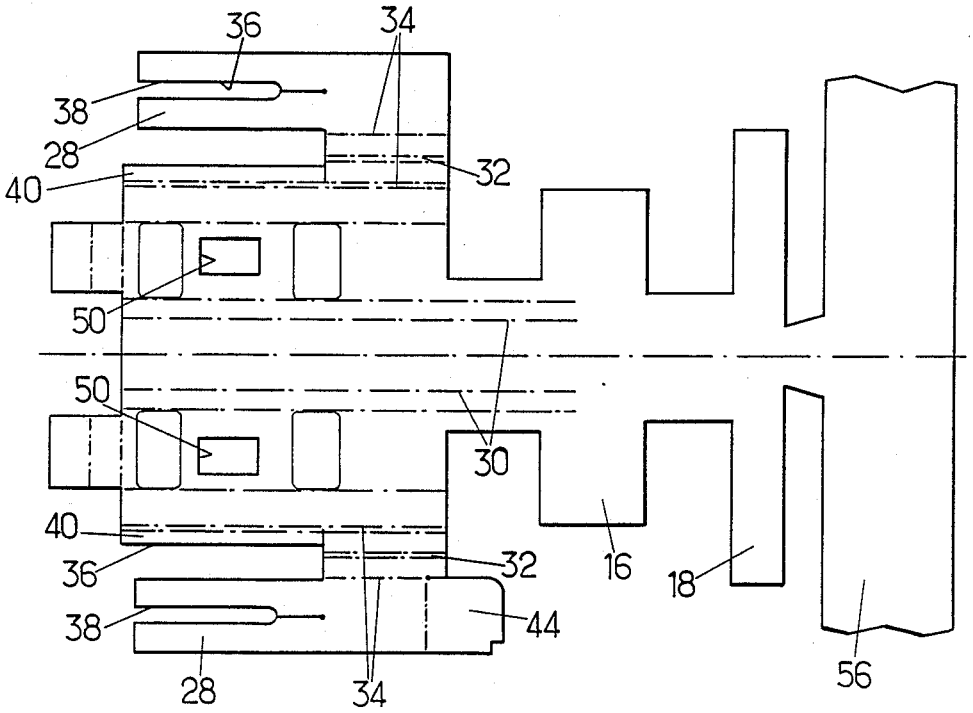
FIG. 2 is a top view of a blank which after bending gives rise to the terminal of FIG. 1.
Figure 3:
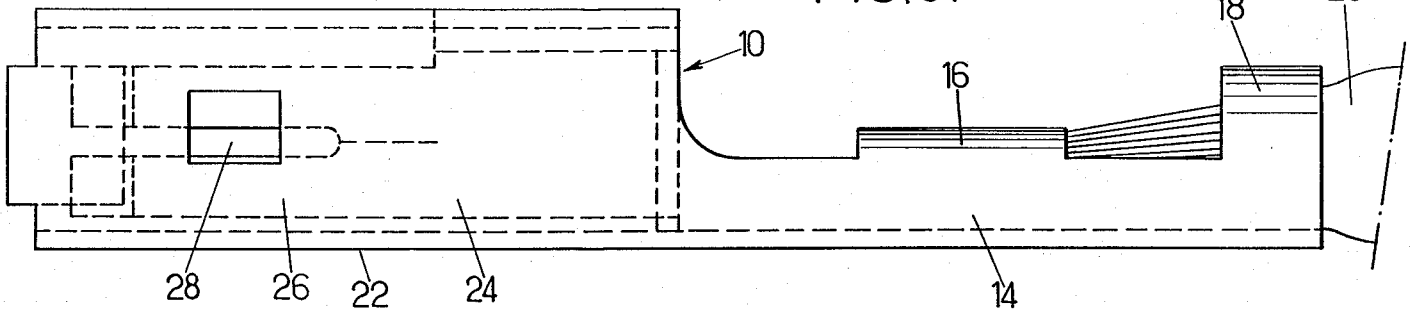
FIG. 3 is an elevational view of the terminal of FIG. 1.
Figure 5:
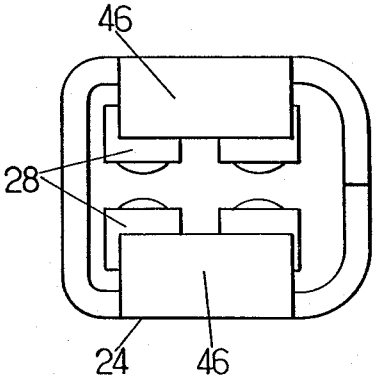
FIGS. 4 and 5 are respectively top and front views of the terminal of FIG. 3.
Figure 4:
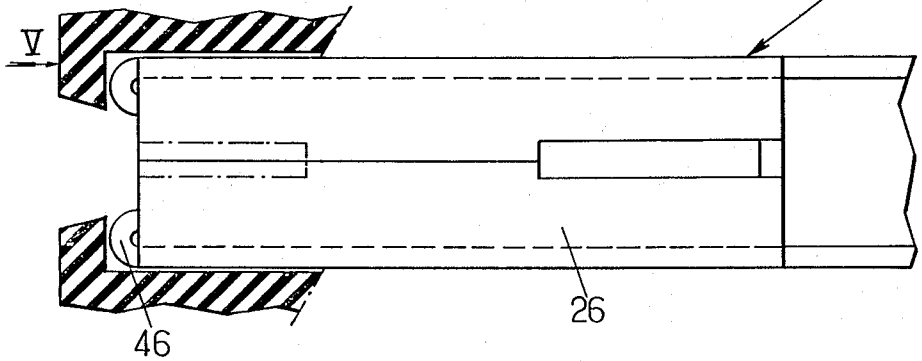

Referring to FIGS. 1 and 3 to 7, a terminal is illustrated which is made starting from a blank of the type shown in FIG. 2; the terminal is for use in a connector whose general construction may be conventional. Terminal 10 is in one piece. It may be regarded as having a front body for receiving a male contact blade 12 and a rear shank 14 to be crimped, only a fraction of which is shown in FIGS. 2 and 4. The shank 14 comprises two sets of tongues 16 and 18, respectively to be crimped on the core and on the sheath of an electric wire 20 (FIG. 3).

The body of terminal 10 has a cage shape with a bottom 22 and two sides 24. Each side 24 comprises an external wall 26 and an internal wall 28. Each external wall 26 is made by bending the original blank through 90° along one of the dash-dot lines 30 in FIG. 2. The internal wall 28 is joined to the external wall 26 by a 180° bend along the edge shown at 32 in FIG. 2. The set of the two walls 26 and 28 has a right angle bend along the lines designated 34 in FIG. 2.

The original blank has cut-outs 36 so shaped that the internal wall 28 is connected to the corresponding external wall 26 only at its rear part. The front portion of each internal wall thus forms a resilient contact bearing intended to contact blade 12.

In the embodiment shown, each internal wall 28 is split by a slit 38 over part of its length from the end, which makes more even bearing possible. Fractionating up is however not indispensable. One of the contacts (or both) could be without slit 38. Conversely, it would be possible to provide more than one slit in each contact.

Figure 8:
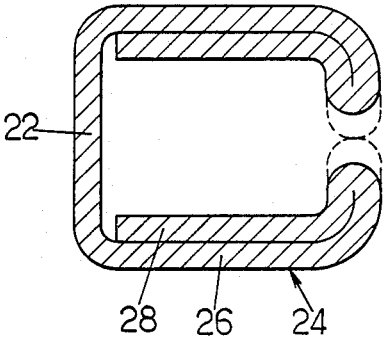

The portions of walls 26 and 28 close to the 180° bend form a cage ceiling. As shown, the original blank is cut to form tongues 40 in mutual abutment against each other and forming a continuous ceiling in the cantilevered zone of the internal walls 28, whereas the 180° bends remain separated by a gap 42. This construction may be of advantage when the terminal is to be placed in a connector where sealing is provided by protrusion of the insulating material of the connector inside the terminal. When on the other hand, maximum crush strength of the terminal is desired, the cut out may be such that the 180° bends are in contact with each other, as shown with broken lines in FIG. 8. The latter construction limits the risks of terminals mutually catching when grouped together in a bunch or loosely and it provides complete protection of the contacts.

A spacer flap extends rearwardly of one of the internal walls 28 and has a 90° bend (FIGS. 2 and 6) for bearing against the other internal wall. The purpose of this flap is primarily to avoid infiltration of the moulding product typically used to seal a connector receiving the terminal is placed. However, the flap may also participate in the resistance to crushing.

Figure 6:
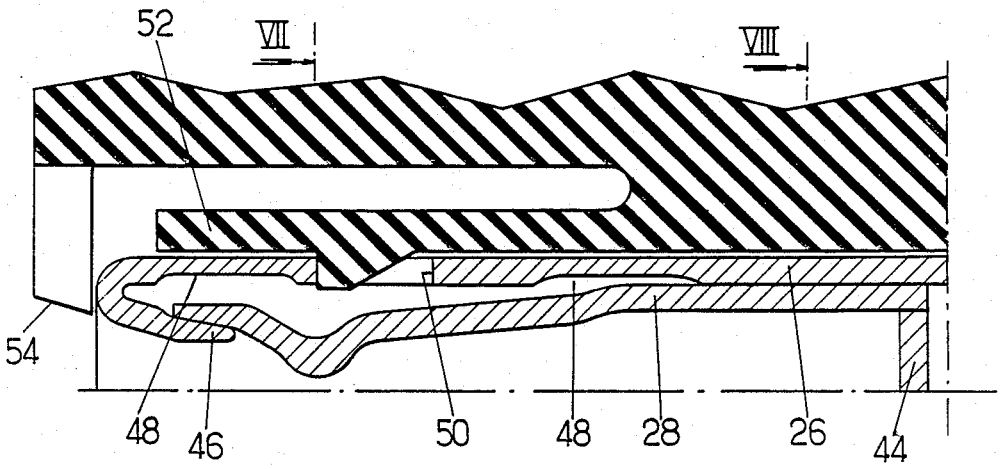
FIG. 6 is a sectional detail view, on an enlarged scale, showing the construction of one of the sides of the terminal.
Figure 7:
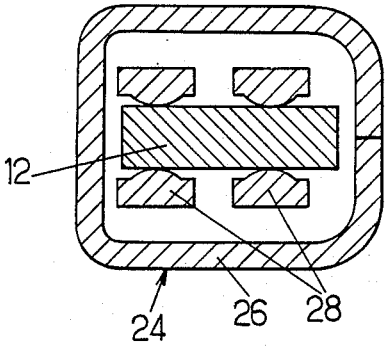
FIGS. 7 and 8 are sectional views through lines VII and VIII of FIG. 6.

Each internal wall 28 advantageously has a shape as shown in FIG. 6. The cantilevered portion, forming an electric contact, has a length slightly larger than half of the total length of wall 28 and it is shaped so as to have an inward camber and a thickened bend whose convexity is directed toward the other wall, in the immediate vicinity of the free end. The resilient force due to the camber of the contact and biasing the two contacts toward each other, is absorbed by a bent back portion 46 of the respective external wall 26. Referring to FIG. 1, the bend of the bent back portions is located in front of the end edges of the bottom and of the ceiling of the cage and has a rounded shape which facilitates insertion of the terminal into an insulator and limits damage to the latter. To further reduce the risk during insertion, the edges of the bottom and of the ceiling may be softened.

Similarly, the corners formed by the sides and the ceiling at the rear of the body may be softened during manufacture.

To increase the amount of free tilting movement of the contacts, the external walls 26 may have shallow recesses 48 (having for example a depth of abut 20% of the thickness of the wall) facing the root of each contact of an internal wall 28 and facing the end portion retained by the bent back portion 46, respectively.

In the external walls 26 are formed openings 50 for receiving locking tabs 52 which may have any of the presently used forms and for locking the terminal in an insulator. As shown in FIG. 6, each tab 52 is formed as an elongated lip formed during moulding of the insulator, having an inwardly directed catch for engaging in an opening 50. Since the tab extends beyond the catch, it is possible to unlock the connector by forcing a tube through and along the front passage 54 of the insulator (defined by an annular lip having a gap for fitting the tab 52), this tube sliding between the side of the terminal and the tab. Due to the symmetrical position of the two openings 50, the terminal may be positioned in either of two symmetrical positions in a chamber of the insulator.

A short description will now be given of a possible method of manufacturing terminals according to the invention, for obtaining terminals in strips for feeding a machine automatically crimping them on wires.

In the case of terminals intended for the electric currents usual in the automobile field, the manufacture is generally carried out by stamping and bending copper alloy sheets having a thickness of from 0.3 to 0.4 mm. In a first work station, the metal sheet is stamped so as to form successive blanks of the type shown in FIG. 2, connected together by a connecting strip 56. The bending lines, shown with dot-dash lines in FIG, 2, may be marked with the press. The contacts are shaped by cambering and hammering for forming the outwardly thickened portion forming a bearing zone. The bent back portions 46 are then formed. As shown in FIG. 6, it is of advantage to reduce the thickness of the contacts in the free end portion and to give a slope, for example of about 15°, to the unit consisting of the end of each bent-back portions and the free end portions of the contacts. Such a slope facilitates introduction of the male contact blade. The recesses 48 may also be formed by hammering, before shaping of the contacts and bending of the blank.

The 180° bend between the internal and external walls and the inward 90° bend separating the portion of the internal wall belonging to the side from that belonging to the ceiling are formed. Then flap 44 is bent inwardly and the cage is closed by bending along those lines 34 which are closest to the axis of the blank.

The invention is not limited to the particular embodiments which have been shown and described by way of examples. Various modifications are possible. For example, it is possible to form a terminal whose faces are not exactly parallel but are sloped; an indentation (shown with dash-dot lines in FIG. 4) intended to receive a sealing tongue for slantwise passage of the male blade, which is required for some sealing embodiments, may be formed at the front of the ceiling of the contact.

I claim:

1. One-piece electric contact terminal of stamped metal sheet for cooperation with a contact blade, having a bottom, two sides connected to said bottom and a ceiling consisting of two parts each connected to one of said sides defining an elongated cage-like body, wherein each of said sides has an internal wall laterally connected to an external wall in tight contact therewith by an 180° bend, and each of said internal walls of said sides has a front cantilevered contact portion projecting forwardly in the direction of elongation, while each of said external walls of said sides has a front flap inwardly bent back about an edge orthogonal to the direction of elongation and retaining a respective one of said cantilevered contact portions out of contact with the other contact portion.

2. Terminal according to claim 1, wherein said edges about which the front flaps are bent back are positioned forwardly of front end edges of the body.

3. Terminal according to claim 1, wherein each of said front flaps and a front end portion of the respective internal wall have an inward slope for defining a passage which tapers rearwardly along the direction of elongation.

4. Terminal according to claim 1, wherein one of said internal walls has a rearward extension which is bent by 90° inwardly for abutment against the other one of said internal walls.

5. Terminal according to claim 1, wherein a window is formed in each of said external walls for receiving a locking finger.

6. Terminal according to claim 1, wherein said two sides are bent at 90° in a rear zone, whereby said 180° bends are mutually confronting and terminate in close proximity and constitute said ceiling in said rear zone.

7. Terminal according to claim 6, wherein said 180° bends are in mutual abutment.

8. Electric contact terminal for slidably receiving a mating planar contact blade, said terminal consisting of a one-piece metal stamping of elongated shape along a direction of elongation comprising a front body and a rear shank arranged to be anchored on a wire, said body including:

a bottom portion of elongated shape along said direction of elongation, a first side having: an external wall connected to said bottom portion by a 90° bend along a line parallel to said direction of elongation and having a further 90° bend to form a ceiling; and an internal wall joined to the external wall along a rear portion thereof by a 180° bend, said internal wall having a rear portion in tight flat abutment against said external wall and a front cantilevered electric contact portion having a resiliency biasing it toward a longitudinal mid-plane of said contact terminal orthogonal to said bottom portion, a second side having: an external wall connected to said bottom portion by a 90° bend along a line parallel to said direction of elongation and having a further 90° bend to form a ceiling; and an internal wall joined to the external wall along a rear portion thereof by a 180° bend, said internal wall having a rear portion in tight flat abutment against said external wall and a front cantilevered electric contact portion having a resiliency biasing it toward a longitudinal midplane of said contact terminal orthogonal to said bottom portion, said first and second sides being mutually symmetrical with respect to said midplane, wherein each of said external walls has a front flap inwardly bent back about an edge orthogonal to the direction of elongation and retaining a respective one of said cantilevered contact portions out of contact with the other contact portion.

9. Terminal according to claim 8, wherein each of said internal walls is separated from the respective external wall by a longitudinal slit forwardly of said rear portion.

10. Terminal according to claim 8, wherein each of said front flaps and a front end portion of the respective internal wall have an inward slope for defining a passage which tapers rearwardly along the direction of elongation over part of the length of said cantilevered contact portions.

* * * * *